US005461191A

United States Patent [19]

Kondo et al.

[11] Patent Number: 5,461,191

[45] Date of Patent: Oct. 24, 1995

[54] CONTROL PANEL OF ELECTRONIC EQUIPMENT FOR SETTING PARAMETERS WITH SIGNAL OPERATION MODE

[75] Inventors: Masao Kondo; Yasunao Abe; Hideaki Shimaya, all of Hamamatsu, Japan

[73] Assignee: Yamaha Corporation, Japan

[21] Appl. No.: 201,170

[22] Filed: Feb. 24, 1994

[30] Foreign Application Priority Data

Feb. 25, 1993 [JP] Japan ..... 5-036893

[51] Int. Cl.[6] ..... G10H 7/00; G10H 1/18

[52] U.S. Cl. ..... 84/615

[58] Field of Search ..... 84/600, 601, 615, 84/620

[56] References Cited

U.S. PATENT DOCUMENTS

| | | | |
|---|---|---|---|
| 4,646,609 | 3/1987 | Teruo et al. . | |
| 4,791,847 | 12/1988 | Nishimoto . | |
| 4,915,007 | 4/1990 | Wachi et al. | 84/622 |
| 4,993,306 | 2/1991 | Ueta et al. | 84/601 |
| 5,288,941 | 2/1994 | Sekizuka | 84/615 |
| 5,350,883 | 9/1994 | Kitamura et al. | 84/644 |

FOREIGN PATENT DOCUMENTS 58-211784 12/1983 Japan .

*Primary Examiner*—William M. Shoop, Jr.
*Assistant Examiner*—Jeffrey W. Donels
*Attorney, Agent, or Firm*—Graham & James

[57] ABSTRACT

A control panel is installed in an electronic equipment for selectively setting a plurality of parameters by a desired value so as to control the electronic equipment. The control panel has first operation members each manipulable initially to undergo a select action for selecting one of the parameters, the same being manipulable subsequently after the select action to undergo an input action for inputting a desired value. At least one second operation member is disposed separately from the first operation members and is manipulable in combination with one of the first operation members to undergo an input action for inputting a desired value. A CPU is responsive to the select and input actions of the same first operation member for setting the selected parameter by the inputted value, and is otherwise responsive in combination to both of the select action of the first operation member and the input action of the second operation member for setting the selected parameter by the inputted value.

5 Claims, 5 Drawing Sheets

CONTROL PANEL OF ELECTRONIC EQUIPMENT FOR SETTING PARAMETERS WITH SIGNAL OPERATION MODE

BACKGROUND OF THE INVENTION

The present invention relates to a control panel installed in an electronic equipment such as an electronic musical instrument for setting a value of parameters effective to control the electronic equipment.

Generally, values of various parameters are inputted and set in order to control and operate the electronic equipment. For example, a game machine is set with input parameters such as an operating speed and a score rate. An audio equipment is set with a tone volume, a balance and a frequency band. A computer machine is set with input data for use in table computation software or else. Further, an electronic musical instrument is set with digital parameters such as a timbre code, a rhythm code and a tempo to effect musical performance.

For instance, the conventional electronic musical instrument is provided with a group of select operation members and another group of input operation members for setting desired values to a multiple of parameters. The select operation member is utilized to select one of the multiple parameters to be set, while the input operation member is utilized to input a desired value for the selected parameter. The select operation members are comprised of multiple keys or switches corresponding to the respective parameters. A player of the electronic musical instrument depresses a certain key corresponding to a parameter to be set for selecting that parameter. On the other hand, the input operation members are comprised of an increment key, a decrement key, a ten key and so on. The player may actuate the increment or decrement key to stepwise increase or decrease an input value. Alternatively, the player may manipulate the ten key to directly or instantly input a desired value so as to set the selected parameter.

However, in the conventional scheme of the parameter setting, initially the select operation member is actuated to select one item of the parameters, and subsequently the input operation member is actuated separately from the actuated select operation member to input a desired value. Stated otherwise, both of the select and input operation members must be manipulated in combination to thereby complicate updating operation of the parameters. Further, such a manipulation may hinder quick select and set operation of the parameters during the course of running state of the electronic equipment such as during the course of musical performance of the electronic musical instrument.

SUMMARY OF THE INVENTION

In order to eliminate the above noted drawbacks of the prior art, an object of the invention is to provide a control panel installed in an electronic equipment, featuring quick setting of plural parameters by simplified sequence of manipulation. According to the invention, a control panel is installed in an electronic equipment for selectively setting a plurality of parameters by a desired value so as to control the electronic equipment. The control panel comprises first operation members each manipulable initially to undergo a select action for selecting one of the parameters, the same being manipulable subsequently after the select action to undergo an input action for inputting a desired value. At least one second operation member is disposed separately from the first operation members and is manipulable in combination with one of the first operation members to undergo an input action for inputting a desired value. The control panel further includes setting means responsive to the select and input actions of the same first operation member for setting the selected parameter by the inputted value, and otherwise being responsive in combination to both of the select action of the first operation member and the input action of the second operation member for setting the selected parameter by the inputted value. By such a construction, once the first operation member is actuated to select one item of the parameters, the same first operation member is subsequently actuated so as to input a desired value which is set to the selected parameter.

DETAILED DESCRIPTION OF THE INVENTION

Figure 1:
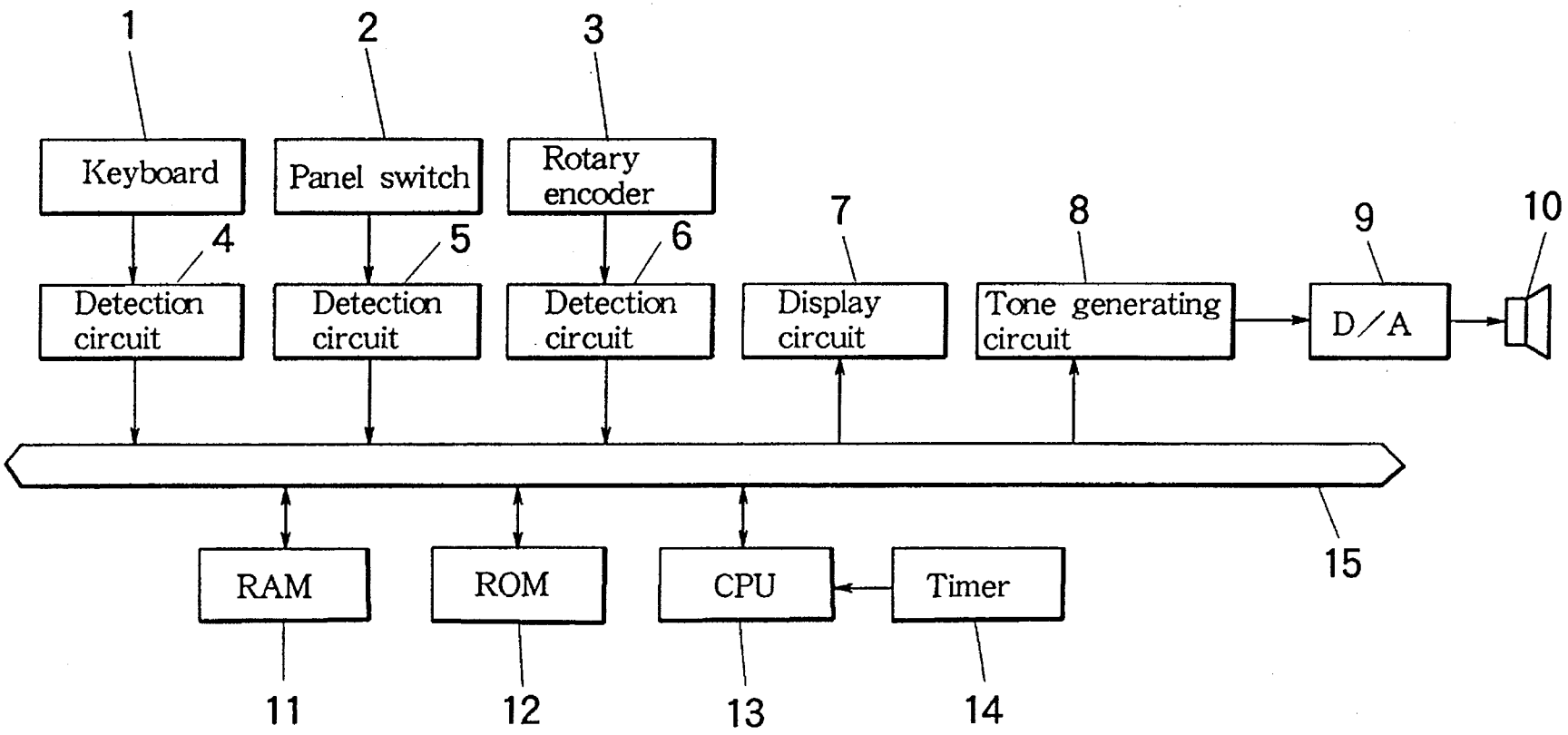
FIG. 1 is a block diagram showing an electronic musical instrument provided with a control panel according to the invention.

FIG. 1 is a block diagram showing an electronic musical instrument installed with a control panel according to the invention. The instrument is provided with a keyboard 1, a panel switch 2 for inputting various performance parameters and a rotary encoder 3 for use in control of musical tones, those of which are connected to a data bus line 15 through respective detection circuits 4, 5 and 6. Detection signals from these detection circuits are inputted into an RAM 11 or a CPU 13. The CPU 13 carries out computation processings of various musical tones and performance parameters according to those of a data stored in the RAM 11, a program stored in an ROM 12 and an interruption signal from a timer 14. Further, the CPU 13 drives a display circuit 7 to display information on a panel and drives a tone generating circuit 8 to form a musical tone signal which is acoustically reproduced by a sound system 10 through a D/A converter 9.

Figure 2:
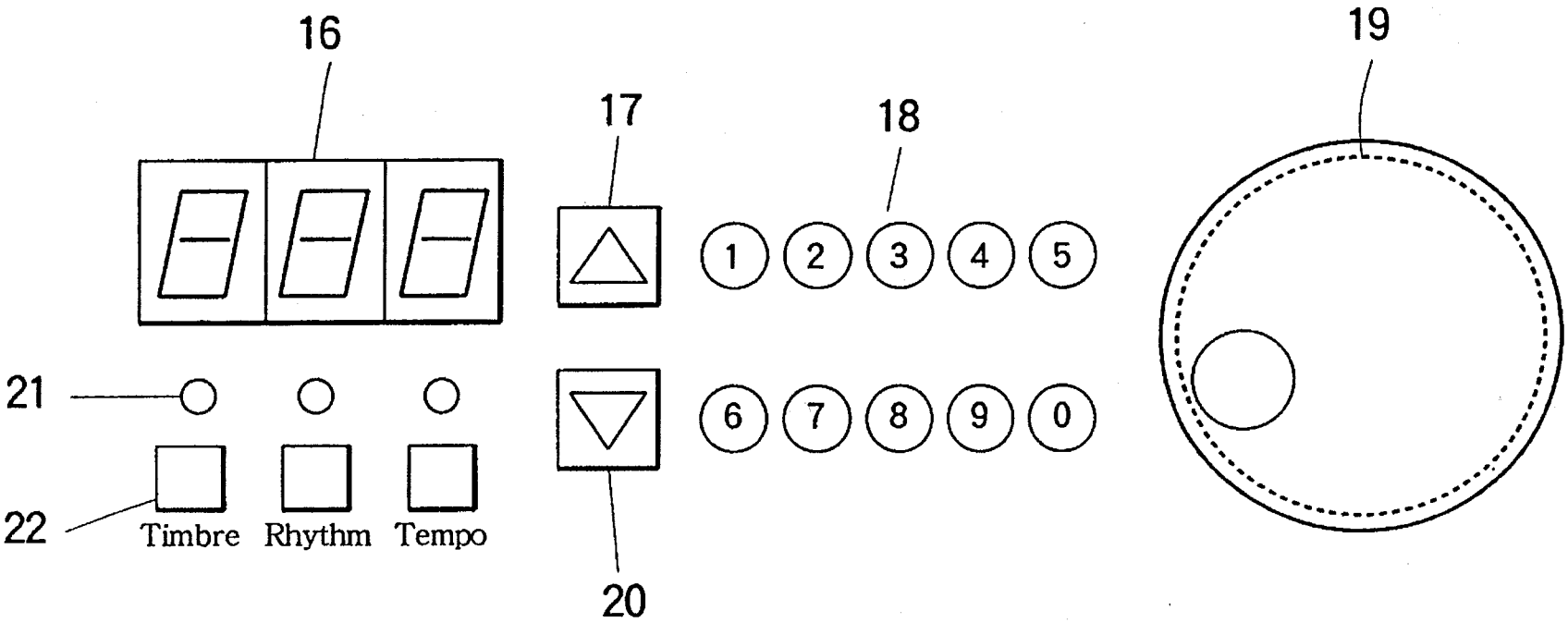
FIG. 2 is an illustrative plan view showing an arrangement of the inventive control panel.

FIG. 2 shows an arrangement of a control panel installed in the electronic musical instrument of FIG. 1. The control panel has a digital LED display 16 for displaying a set value of a selected parameter or else. The control panel further includes a group of input operation members such as an increment key 17 manipulable to stepwise increase an input value, a decrement key 20 manipulable to stepwise decrease an input value, and a ten key 18 manipulable to input a numerical value. In addition, a rotary encoder 19 is provided in connection to a rotary volume for controlling various musical tones. The control panel has another group of select operation members 22 in the form of select switches manipulable to select one of performance parameters including a timbre, a rhythm and a tempo. LED indicators 21 are disposed correspondingly to the select operation members 22 so as to indicate a selected one of the parameters. Though not shown in the figure, the control panel may contain a power switch, a tone volume switch, other select switches and control switches.

Figure 3:
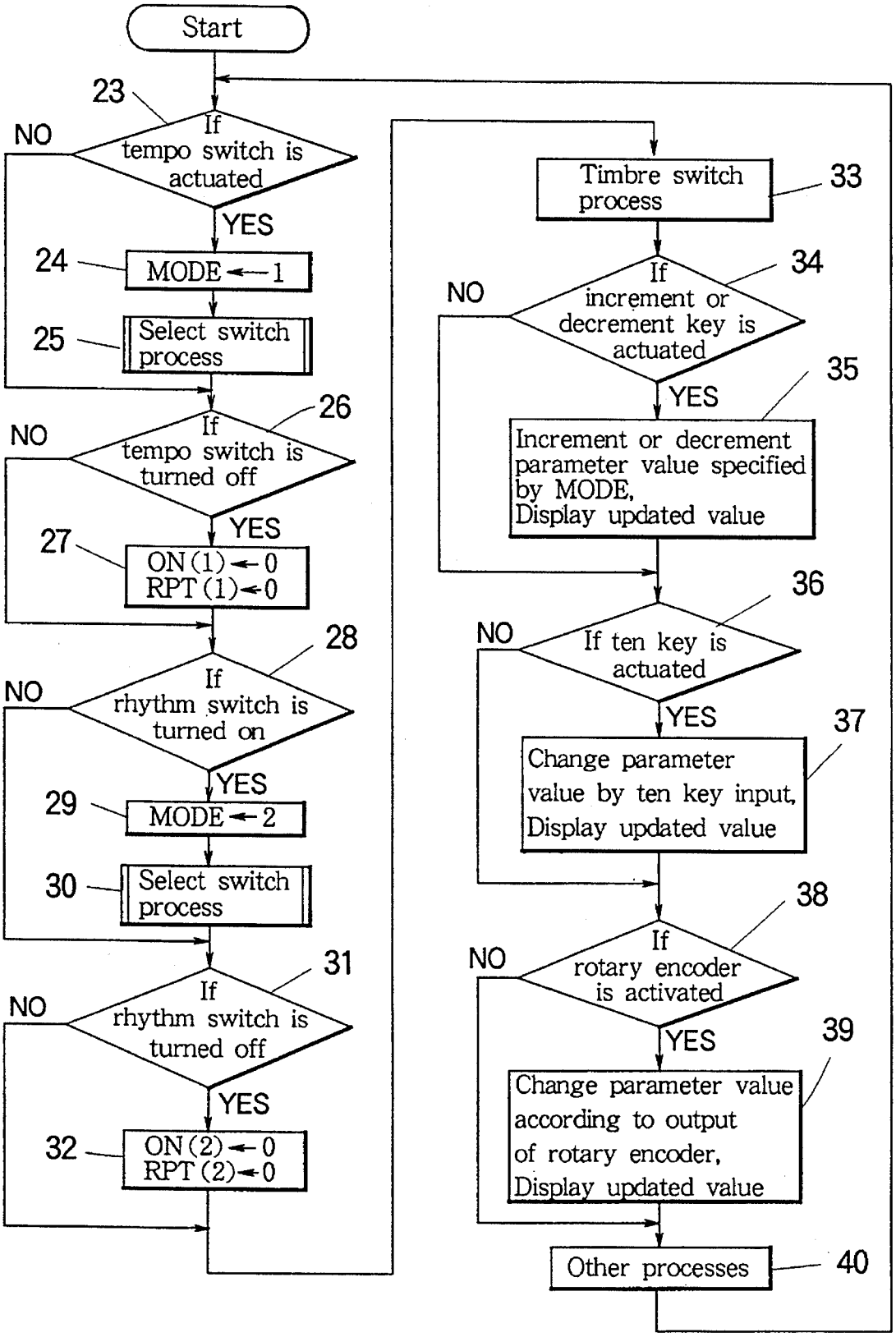
FIG. 3 is a flowchart showing a main routine of parameter setting procedure by the inventive control panel.
Figure 4:
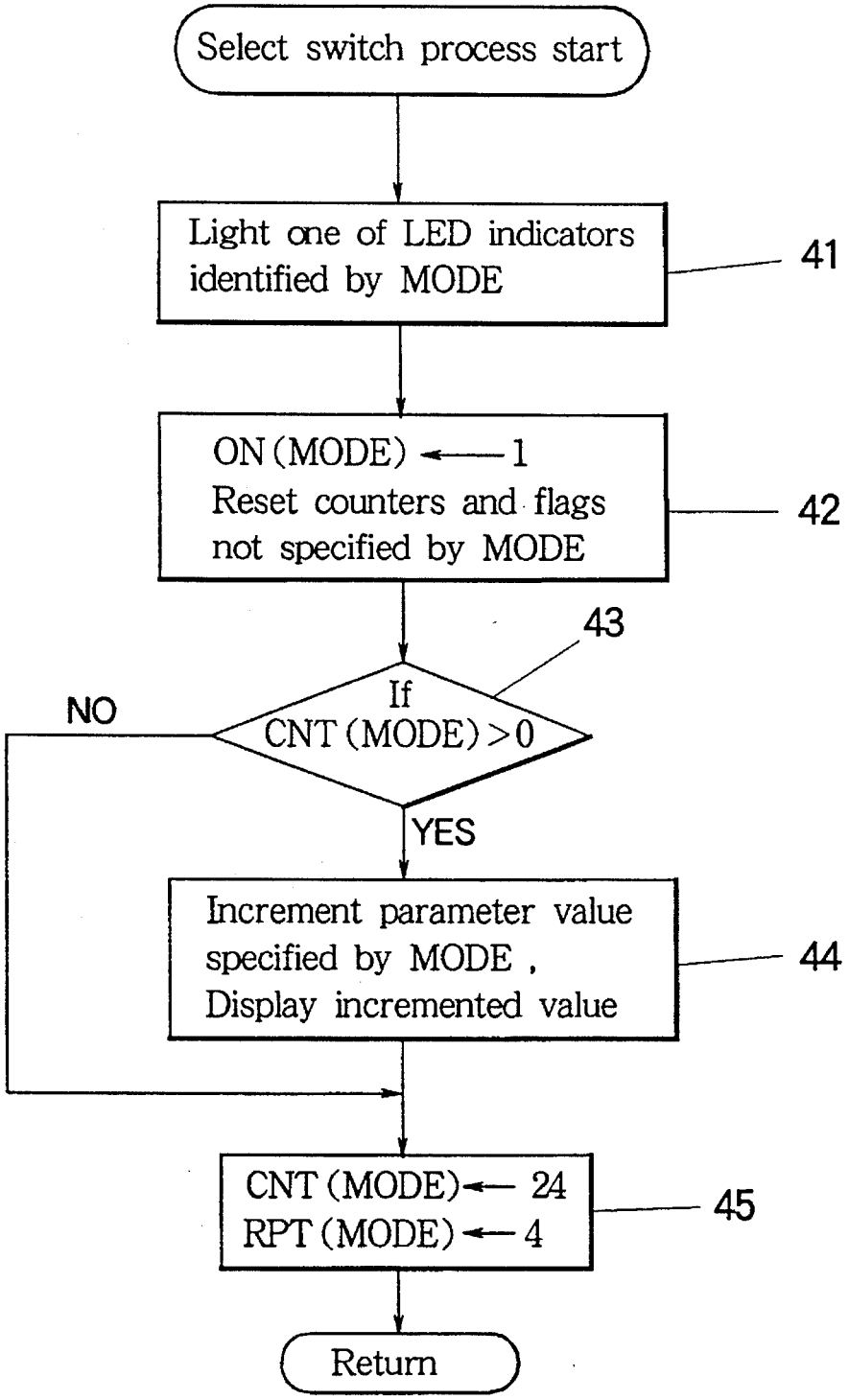
FIG. 4 is a flowchart showing a subroutine of select switch process in the FIG. 3 main routine.
Figure 5:
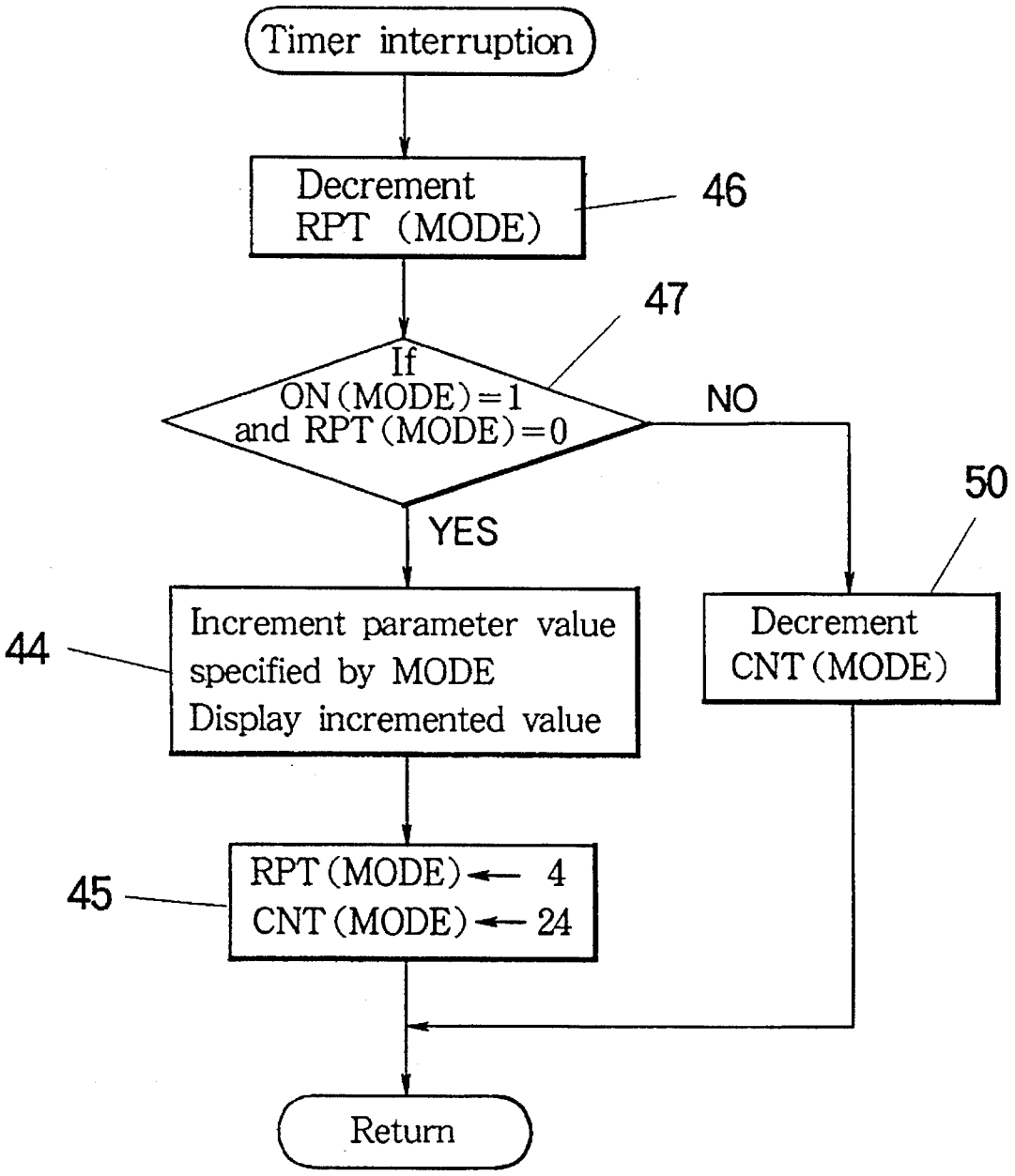
FIG. 5 is a flowchart showing a timer interruption routine called in the FIG. 3 main routine.

FIG. 3 is a flowchart showing a main routine of parameter setting procedure by means of the switches and keys disposed on the control panel of FIG. 2. FIG. 4 shows a subroutine of select switch processing involved in the FIG. 3 main routine, and FIG. 5 shows a timer interruption routine called in the FIG. 3 main routine. In these flowcharts, a notation "MODE=1" indicates a tempo setting mode, and a notation "MODE=2" indicates a rhythm setting mode. Further, there are various registers, counters and flags such as a flag ON(MODE) indicative of an on-state of a select switch, a time counter CNT(MODE) for counting a time which lapses from a switch-on, and another time counter RPT(MODE) for use in switch repeat function. The switch repeat function means that a continuous depression of a switch can effect a switch-on event every given period of time.

Hereinafter, description is given to the parameter setting procedure according to the invention in conjunction with the flowcharts of FIGS. 3–5, where a tempo value is set for musical performance. Initially, a player of the electronic musical instrument selects and depresses a tempo switch among the select operation members 22 on the control panel in order to carry out tempo setting process. This select action of the tempo switch is detected by the detection circuit 5 (FIG. 1). Then, the CPU 13 executes, based on the detected result, the parameter setting procedure according to the program stored in the ROM 12 as follows.

Namely in Step 23, check is made as to if the tempo switch is placed in on-event, i.e., as to if the tempo switch is depressed to undergo the select action. Since the tempo switch has been actually depressed, the processing advances to Step 24. In this step, MODE=1 is set to indicate the tempo setting mode.

Then, the processing proceeds to Step 25 of select switch process, a detailed routine of which is shown in FIG. 4. Firstly, Step 41 is undertaken to light one of LED indicators 21 (FIG. 2) corresponding to the tempo switch identified by MODE. Further, Step 42 is undertaken to set the flag ON(MODE)=1 to indicate that the tempo setting mode is established while counters and flags associated to the timbre and rhythm parameters are reset.

Next, check is made in next Step 43 as to if the content of CNT(MODE) is greater than "0". In this embodiment, the content of CNT(MODE) is set with "24" everywhen a corresponding select operation member is actuated. The content of CNT(MODE) is stepwise decremented every 200 ms. Consequently, the counter value reaches "0" when 200 ms×24=5 sec has passed after the tempo switch was turned on (or after the tempo value was updated by the subsequent actuation of the tempo switch as will be described later). In such a manner, when the time has passed more than 5 sec after the initial or previous switch-on event, the content of CNT(MODE) reaches "0" so that the check result of Step 43 is found No. Then, Step 45 is undertaken to set CNT(MODE)=24 and RPT(MODE)=4, thereby finishing the subroutine of the select switch process (step 25 of FIG. 3) to return to Step 26 of the main routine.

On the other hand, when the tempo switch is again actuated within 5 sec after the previous actuation of the same tempo switch, the counter value remains over "0" so that the check result of Step 43 is found YES. Consequently, Step 44 is undertaken to increment the tempo value by "1", This incremented value is indicated in the LED display 16 (FIG. 2). Then, the counter CNT(MODE) is set to "24" in Step 45, thereby returning to Step 26 of the FIG. 3 main routine. By such a manner, the tempo switch is actuated among the select operation members initially to undergo the select action for selecting the tempo parameter. The same tempo switch is again depressed within 5 sec subsequently after the previous select action to undergo the input action for changing the value of the selected tempo parameter. The same tempo switch may be further actuated within 5 sec after the previous input action to again increment the tempo value by the same sequence to thereby update the displayed tempo value.

In this embodiment, the switch repeat function is additionally provided such that the tempo switch may be continuously depressed so that the tempo value is incremented every 800 ms (corresponding to four counts) by the timer interruption process as will be described later. For this purpose, the counter RPT(MODE) is set to "4" in Step 45.

Once the parameter value is incremented, the time counters CNT(MODE) and RPT(MODE) are reset in Step 45. The reset values "24" and "4" of the respective counters CNT(MODE) and RPT(MODE) are stepwise decremented every 200 ms by the timer interruption routine. As shown in FIG. 5, the timer interruption routine is commenced every 200 ms in response to the interruption signal which is fed to the CPU 13 from the timer 14. Firstly, the switch repeat time counter RPT(MODE) is decremented ill Step 46. Next, check is made in Step 47 as to if ON(MODE)=1 and RPT(MODE)=0, i.e., as to if the select operation member 22 is continuously depressed to keep the input action over 0.8 sec. If NO, the counter CNT(MODE) is decremented in Step 50. By such a manner, the reset value "24" of the CNT(MODE) is stepwise decreased every 200 ms. During the course of repeating such a routine, when the counter RPT(MODE) reaches "0" by continuous depression of the select operation member over 0.8 sec, the check result of Step 47 is turned YES. Consequently, Step 44 is undertaken to increment the tempo value. Further, RPT(MODE) is reset to "4" and CNT(MODE) is reset to "24" in Step 45.

Returning to the main routine of FIG. 3, the processing proceeds to Step 26 when there is no on-event of the tempo switch or when the select switch process is finished. In Step 26, check is made as to if an off-even occurs at the tempo switch, i.e., as to if the tempo switch is turned off. If YES, Step 27 is undertaken to change the switch-on flag ON(1) to "0" and to reset the switch repeat time counter RPT(1) to "0". By such a manner, the particular select operation member is manipulated to select the tempo parameter, and further the same select operation member is manipulated without shifting a finger of the player's hand so as to set the value of the tempo parameter.

Then, Step 28 is undertaken to check as to if an on-event occurs at the rhythm switch among the select operation members, i.e., as to if the rhythm switch is turned on. The check result is found NO during the setting of the tempo parameter to thereby jump to Step 31. On the other hand, when the rhythm switch is actuated, subsequent Step 29 is undertaken to set MODE=2. Then, the select switch process is carried out in Step 30 so as to set the rhythm parameter through the select switch process subroutine of FIG. 4 and the timer interruption routine of FIG. 5. Further, Steps 31 and 32 are undertaken in manner similar to Steps 26 and 27.

Then, Step 33 is undertaken to carry out timbre switch process so as to set the timbre parameter. Though not shown in the flowchart, this timbre switch process includes substeps likewise the tempo or rhythm setting. Namely, the timbre switch is actuated sequentially twice or more to set the timbre parameter in manner similar to the settings of the tempo and rhythm parameters.

Then, Step 34 is undertaken to check as to if either of the increment key 17 and the decrement key 20 is actuated in combination with one of the select operation members 22 (FIG. 2), which is actuated to select a desired parameter to be set. When the increment key 17 or the decrement key 20 is manipulated to undergo the input action, the value of the selected parameter is incremented or decremented in Step 35. The updated parameter value is indicated in the LED display 16.

Further, Step 36 is undertaken to check as to if the ten key 18 is actuated to set a value of a selected parameter. When the ten key 18 is actuated, the parameter value is accordingly changed and is indicated in the LED display 16 in Step 37. In similar manner, check is made in Step 38 as to if the rotary encoder 19 is activated. If this check result is found YES, subsequent Step 39 is carried out such that the selected parameter identified by MODE is incrementally or decrementally updated according to an output of the rotary encoder 19, and the updated result is indicated in the LED display 16. On the other hand, when the select operation member 22 is sequentially manipulated to set the parameter value without using the separate input operation members such as the increment key 17, the ten key 18, the rotary encoder 19 and the decrement key 20, the check results of Steps 34, 36 and 38 are all found NO. Lastly, Step 40 is undertaken to carry out other processes than the parameter setting process, such as manual performance process in response to the keyboard play and automatic performance process. After the various processes of Step 40 are finished, the main routine returns to Step 23 to repeat the same sequence.

In the disclosed embodiment, the parameter value is updated when the select operation member is subsequently actuated within a predetermined time interval (for example, 5 sec) after the same is initially actuated or when the select operation member is continuously depressed over a predetermined time interval (for example, 0.8 sec). However, other variations may be adopted according to the invention. For example, a pressure sensitive select operation member can be utilized such that the parameter value is set when the pressure sensitive member is further depressed intensively after the same is lightly touched for the parameter selection. Further, the parameter value may be set by sequential depressing of the same select operation member regardless of a time interval between preceding and succeeding actuations. Though the parameter value is incrementally set by the select operation member in the present embodiment, alternatively the parameter value may be decrementally updated. Otherwise, the incremental and decremental settings may be switched by manipulation manner of the select operation member. For example, the incremental setting is effected when the operation member is actuated only once within the predetermined time interval after the selection of the parameter. Otherwise, the decremental setting is effected when the operation member is actuated twice after the selection of the parameter. Though the invention is specifically applied to the electronic musical instrument in the present embodiment, the invention can be applied to a general electronic equipment such as a game machine, an audio equipment and a computer machine containing various electronic control devices.

As described above, according to the invention, the input of the parameter value is effected not only by the input operation member but also by the select operation member such that the select operation member is actuated subsequently after the same is initially actuated for the parameter selection. Accordingly, the parameter setting is achieved by the sequential manipulation of the single operation member in simplified and quick manner. The present invention may be effectively applied to the electronic musical instrument such that the select and set of the control parameters can be achieved by quick manipulation during the course of the musical performance to thereby expand variety of the performance.

What is claimed is:

1. A control panel installed in an electronic equipment for selectively setting a plurality of parameters by a desired value so as to control the electronic equipment, the control panel comprising:

first operation members each manipulate initially to undergo a select action for selecting one of the parameters, the same being manipulable subsequently after the select action to perform an input action for inputting a desired value;

at least one second operation member disposed separately from the first operation members and being manipulable to perform an input action for inputting a desired value of the parameter selected by the first operation members; and setting means responsive to the select and input actions of the same first operation member for setting the selected parameter by the inputted value, and also being responsive in combination to both of the select action of the first operation member and the input action of the second operation member for setting the selected parameter by the inputted value.

2. A control panel according to claim 1, wherein the setting means includes means for setting the selected parameter by the inputted value when the first operation member undergoes the input action within a predetermined time interval after the same undergoes the select action.

3. A control panel according to claim 1, wherein the setting means includes means for setting the selected parameter by the inputted value when the first operation member undergoes the input action continuously over a given time interval.

4. A control panel according to claim 1, being installed in an electronic musical instrument for selectively setting a plurality of parameters so as to control musical performance of the electronic musical instrument.

5. A control panel installed in an electronic equipment for selectively setting a plurality of parameters by a desired value so as to control the electronic equipment, the control panel comprising:

first operation means for selecting one of a plurality of input modes which correspond to the plurality of the parameters, respectively;

second operation means disposed independently form the first operation means for inputting a desired value; and setting means operative for setting the inputted value to a particular parameter which corresponds to the selected input mode, and further being operative when the selected input mode is again selected by the first operation means for changing a value of a particular parameter which corresponds to the selected input mode.

* * * * *